US005771770A

United States Patent [19]

Müller

[11] Patent Number: 5,771,770

[45] Date of Patent: Jun. 30, 1998

[54] CUTTING CYLINDER WITH ADJUSTABLE CUTTER BAR

[75] Inventor: Roger Müller, Bern, Switzerland

[73] Assignee: Maschinenfabrik WIFAG, Bern, Switzerland

[21] Appl. No.: 684,035

[22] Filed: Jul. 19, 1996

[30] Foreign Application Priority Data

Jul. 20, 1995 [DE] Germany ..... 195 26 507.6

[51] Int. Cl.[6] ..... B26D 1/62; B26D 7/26; B41F 13/60

[52] U.S. Cl. ..... 83/698.61; 83/674; 83/677

[58] Field of Search ..... 83/698.61, 343, 83/344, 345, 346, 348, 349, 674, 677

[56] References Cited

U.S. PATENT DOCUMENTS

| | | | |
|---|---|---|---|
| 1,685,532 | 9/1928 | Bechman | 83/345 X |
| 1,937,519 | 12/1933 | Lamatsch | 83/345 X |
| 1,963,734 | 6/1934 | Crafts | 83/677 X |
| 2,095,631 | 10/1937 | Cumfer | 83/346 X |
| 3,128,663 | 4/1964 | Dovey | 83/698.61 X |
| 3,251,256 | 5/1966 | McGrath | 83/698.61 X |
| 3,288,007 | 11/1966 | Eda et al. | 83/674 X |
| 3,477,328 | 11/1969 | Schonmeier et al. | 83/698.61 X |
| 3,593,609 | 7/1971 | Schonmeier | 83/677 X |
| 3,857,314 | 12/1974 | Gregoire | 83/346 |
| 4,240,313 | 12/1980 | Gillespie | 83/698.61 X |
| 4,392,402 | 7/1983 | Rann | 83/345 |
| 4,709,607 | 12/1987 | Buhayar | 83/345 X |
| 4,781,095 | 11/1988 | Yoshida | 83/698.61 X |
| 5,048,387 | 9/1991 | Niitsuma et al. | 83/674 X |
| 5,159,868 | 11/1992 | Thomas et al. | 83/346 X |
| 5,367,936 | 11/1994 | Held et al. | 83/698.61 |
| 5,465,641 | 11/1995 | Herd | 83/698.61 |

FOREIGN PATENT DOCUMENTS

| | | | |
|---|---|---|---|
| 1441546 | 5/1966 | France | 83/348 |
| 3544285 A1 | 6/1987 | Germany | 83/346 |
| 42 07 209 A1 | 9/1993 | Germany . | |
| 42 44 786 A1 | 2/1995 | Germany . | |
| 42 44 787 A1 | 2/1995 | Germany . | |
| 1231016 | 5/1971 | United Kingdom | 83/348 |

*Primary Examiner*—Eugenia Jones
*Assistant Examiner*—Charles Goodman
*Attorney, Agent, or Firm*—McGlew and Tuttle

[57] ABSTRACT

A cutting cylinder for transversely cutting or perforating a material web running in a rotary press, preferably a printed web in a rotary printing press, has at least one displaceable cutter bar. The cutter bar, pressing a displacing surface provided at the cutting cylinder with a contact surface, is displaceable in the circumferential direction of the cutting cylinder by an adjusting device connected to the cutter bar in a frictionally engaged manner pressing the cutter bar via at least one wedge surface. The wedge surface points toward the displacing surface at an acute angle (α).

12 Claims, 9 Drawing Sheets

CUTTING CYLINDER WITH ADJUSTABLE CUTTER BAR

FIELD OF THE INVENTION

The present invention pertains to a cutting cylinder for transversely cutting or perforating a web of material running in a rotary press, preferably a printed web in a rotary printing press, with at least one cutter bar, which, pressing a displacing surface provided at the cutting cylinder with a contact surface, is displaceable in the circumferential direction of the cutting cylinder by an adjusting means connected to the cutter bar in a frictionally engaged manner pressing the cutter bar via at least one wedge surface.

BACKGROUND OF THE INVENTION

To transversely cut or perforate a web of material running through a rotary press into web sections of different lengths by means of a cutting cylinder, the cutter or cutters of the cutting cylinder must be adjustable in the circumferential direction of the cutting cylinder. This adjustability is desired, e.g., in the case of a changeover from collect-run production to double production or vice versa in rotary printing, which is the preferred, but not the only field of application of the present invention.

In the cutting cylinder known from DE 42 44 786 A1, a cutter bar is displaceable on a cylinder-side displacing surface by means of forces of pressure, which can be applied to its two long sides. Flexible pressure tubings, which extend along the sides and to which a pressurized medium can be alternatingly admitted, are arranged to apply the forces of pressure. In another alternative, a spring, against the restoring force of which the cutter bar is displaceable by a flexible pressure tubing, is provided opposite the flexible pressure tubing. The cutting bar is pressed against the displacing surface of the cutting cylinder by a plurality of sliding blocks, which are pressed onto the cutter bar by compression springs.

In a cutting cylinder known from DE 42 44 787 A1, a cutter bar is designed as a wedge-shaped cutter bar at least on one of its long sides. This long side is connected to a complementarily wedge-shaped strip, which is movable in the axial direction of the cutting cylinder, in a frictionally engaged manner. The displacement of the cutter bar in the circumferential direction will again take place against restoring springs, which act against the opposite long side of the cutter bar.

The adjustment in the circumferential direction of the cutting cylinder also takes place due to a displacement of a strip provided with wedge surfaces in the axial direction of the cylinder in a cutter bar known from DE 42 07 209 A1. Due to the wedge surfaces sliding off on cutter bar-side hinge surfaces, the cutter bar is displaced by correspondingly arranged compression springs against the elastic restoring force. The cutter bar must in turn be held separately at its cylinder-side displacing surface, on which it is displaceable in the circumferential direction.

SUMMARY AND OBJECTS OF THE INVENTION

The primary object of the present invention is to make possible the adjustment of a cutter bar in the circumferential direction of the cylinder in a cutting cylinder with a simple design and at low cost.

According to the invention, a cutting cylinder is provided for transversely cutting or perforating a material web running in a rotary press, preferably a printed web in a rotary printing press. At least one cutter bar is provided which, pressing a displacing surface provided at the cutting cylinder with a contact surface, is displaceable in the circumferential direction of the cutting cylinder by an adjusting means connected to the cutter bar in a frictionally engaged manner pressing the cutter bar via at least one wedge surface. The wedge surface points toward the displacing surface at an acute slope angle.

In a cutting cylinder according to the present invention, a cutter bar is displaced in the circumferential direction of the cylinder by a force of pressure that brings about the displacement being applied to the cutter bar via a wedge surface. According to the present invention, this wedge surface points toward a displacing surface of the cutting cylinder at an acute angle. The displacing surface here is the surface onto which the cutter bar is pressed and on which it can be displaced. Due to the orientation of the wedge surface according to the present invention, via which the force of pressure acts on the cutter bar, the external force acting on the cutter bar is reduced to two components, the first of which brings about the displacement of the cutter bar, while the second component presses the cutter bar against its cylinder-side contact surface, namely, the displacing surface. The holding means known from the state of the art can thus be omitted in the design of the cutter bar according to the present invention.

An adjusting means, which applies an adjusting force, namely, the external force, preferably acts on the cutter bar not only via one wedge surface, but via two complementary wedge surfaces as well. One of the two wedge surfaces is provided at the cutter bar and the other at the adjusting means. It would, however, also be possible, in principle, to provide only one wedge surface, which would be provided at, e.g., the cutter bar, and to apply the adjusting force by a roller, which is arranged at the adjusting means and rolls off on the wedge surface.

The adjusting means is preferably displaceable to and fro in a straight line essentially at right angles to the displacing surface of the cutting cylinder. However, the direction of movement of the adjusting means may also be tilted, in principle, in relation to the displacing surface.

At least one adjusting means according to the present invention each is arranged on both long sides of the cutter bar according to a preferred embodiment of the present invention.

The cutter bar is advantageously moved by the adjusting means against a fixed stop. Even though the fixed stop may be rigidly connected to the cutting cylinder, it is preferably formed by the adjusting means arranged on the other long side of the cutter bar, which adjusting means is brought into a corresponding stop position for this purpose. When this adjusting means is returned into its stop position, it may be quite advantageous for this adjusting means during the adjustment of the cutter bar to still press the cutter bar with a force that is, however, weaker than that of the "active" adjusting means. It may also continue to exert in its stop position an elastic restoring force on the cutter bar, which force is weak relative to the force of pressure of the active adjusting means, but it is fixed in this position such that it cannot be displaced farther against restoring forces and it forms the fixed stop itself for the cutter bar as a result.

The adjusting means is tensioned according to the present invention by an elastic pretensioning force, applying contact pressure on the cutter bar. The pretensioning force is preferably applied by a spring, especially a compression spring in the form of a spring assembly, so that it is guaranteed at a high level of probability that the cutter bar is always tensioned against its cylinder-side displacing surface. The reliability of operation is especially high, because the spring force always fixes the cutter bar in its stop position, independently from the other, trouble-prone systems.

The contact pressure of the adjusting means on the cutter bar can preferably be reduced. This is advantageous when the cutter bar is to be displaced toward this adjustment means, i.e., when the adjusting means is passive. The cutter bar does not need in this case to be displaced against the pretensioning force acting on the adjusting means, at least not against the full pretensioning force, as it happens in the case of the prior-art cutting cylinders, namely, when the cutter bar is displaced against a restoring spring. An external opposing force opposing the pretensioning force is preferably applied to the adjusting means by a pressurized medium. The pressurized medium is preferably air or oil or a combination thereof, especially in the form of two circuits connected in series.

A cutter bar is preferably made of a plastic to ensure that the centrifugal force acting on the cutter bar as a consequence of the rotation of the cylinder will remain as low as possible because of the low specific gravity of plastics. The pretensioning force acting on the adjusting means, which generates the contact pressure on the cutter bar, can be kept as a result lower than it would be possible in the case of a cutter bar made of steel or even a light metal. The means generating the pretensioning force, preferably spring assemblies, are relieved as a result. For further relief, the adjusting means may also be made of plastic.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
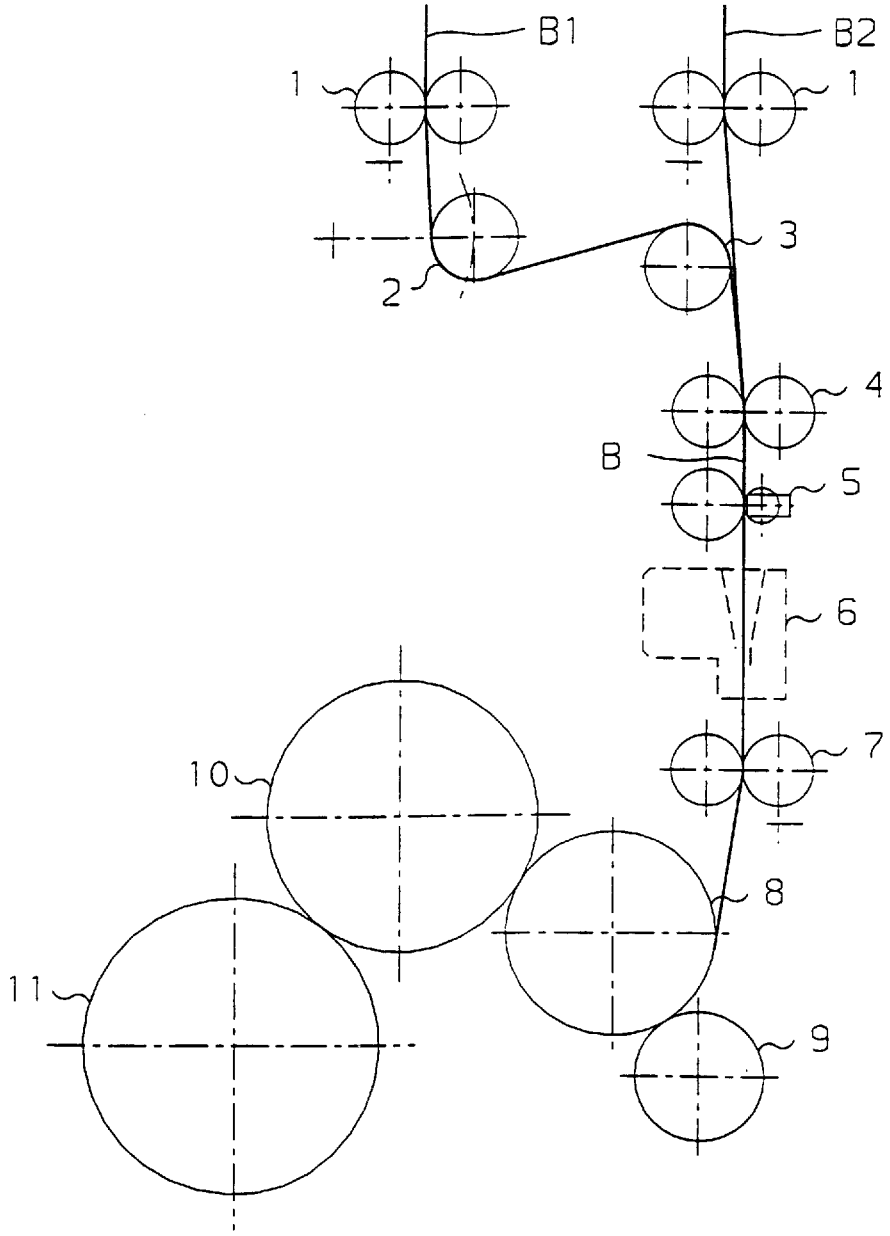
FIG. 1 is a schematic view showing the entry of a printed web into a folder of a rotary printing press.

FIG. 1 shows the entry of a printed web B into a folder. Two printed webs B1 and B2, already folded, run over a pair of draw rollers 1 each and are brought together behind the deflecting roller 3 after the printed web B1 has been deflected around a compensator roller 2 and the deflecting roller 3 arranged downstream of it. The printed web B brought together subsequently runs through a draw roller pair 4 with a retaining device 5 arranged downstream of it, before it is passed through a web-severing device 6. Another draw roller pair 7 is arranged behind the web-severing device 6, and the printed web B is fed into a collecting cylinder 8 of a folder after passing through the second draw roller pair 7. The printed web wrapped around the collecting cylinder 8 is cut transversely by means of a cutting cylinder 9. The cut printed copies are subsequently transferred from the collecting cylinder 8 onto a folding jaw cylinder 10, folded transversely, after which they reach a delivery via a spider wheel 11.

To make it possible to run both double production and collect-run production, it is desirable to have a possibility of changing the length of the printed copies. While the printed copies always have the same length during double production, the inner part of a printed product should be shorter than the outer part in collect-run production in order to prevent a short piece of the inner part from being also cut off during the cutting of the outer part, which would lead to contamination of the folder and consequently to malfunctions.

Figure 2:
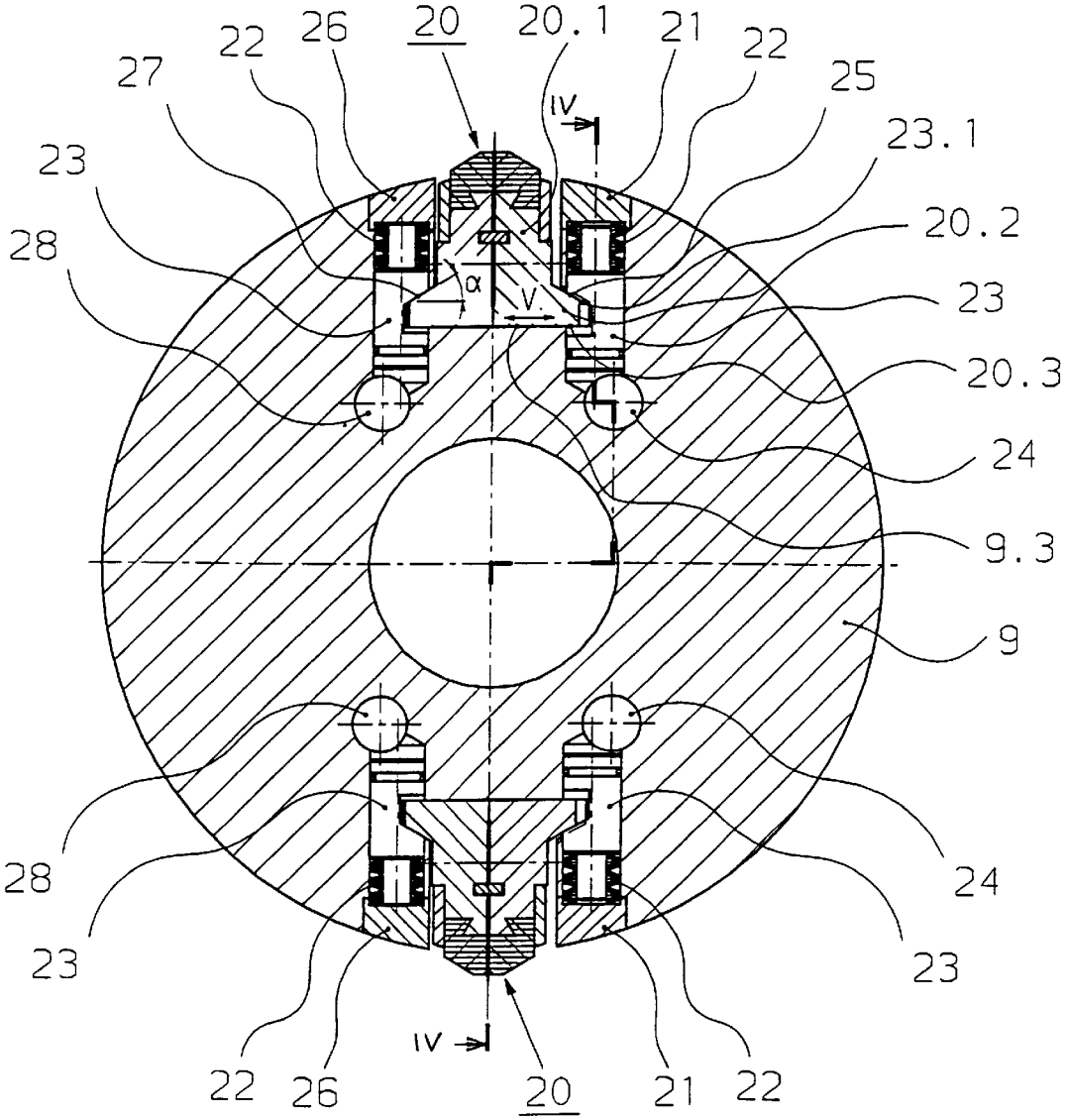
FIG. 2 is a sectional view showing a cutting cylinder designed according to the present invention with a cutter bar, which is located in a first stop position and is adjustable in the circumferential direction of the cylinder.
Figure 3:
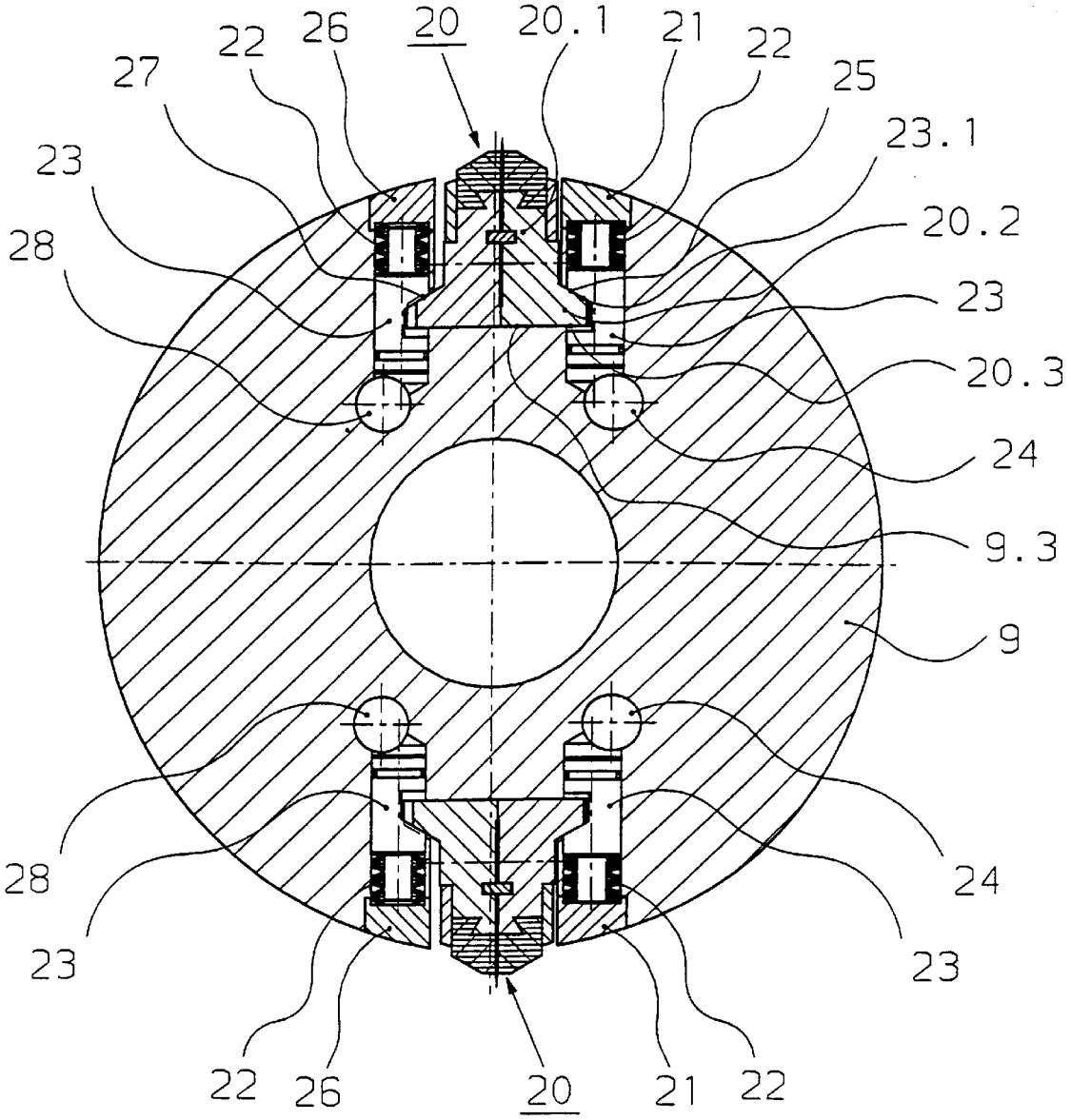
FIG. 3 is a sectional view showing a cutting cylinder according to FIG. 2, in which the cutter bar is located in a second stop position.

FIG. 2 shows the cross section of the two-part cutting cylinder 9 with two diametrically opposed cutter bars 20, which are displaceable in the circumferential direction of the cylinder 9 and are slidingly displaceable in the exemplary embodiment shown. The two cutter bars 20 may be positioned in two fixed positions each, hereinafter called stop positions. The first stop position of the cutter bars 20 is set in FIG. 2. The cutting cylinder 9 is set for double production in this stop position. The circumferential distance between the cutter bars or cutters is the same in both circumferential directions. The two cutter bars are displaced into their second stop positions in the case of collect-run production. This position of the cutter bars is shown in FIG. 3. The cutter bars 20 are now both displaced toward each other, so that one cut length of the printed web will be longer and the other will be shorter. It should be borne in mind that the short copy is first transferred to the collecting cylinder 8 in the case of collect-run production, and the longer copy will then come to lie on it, so that a printed copy of regular length, i.e., a flush printed copy, is formed after the second cross folding in the folding jaw cylinder 10.

The two cutter bars 20 of the cutting cylinder 9 according to FIG. 2 and the adjusting devices associated with them have an identical design, so that only one cutter bar and one adjusting device will always be referred to in the following.

The cutter bar 20 in the exemplary embodiment has an essentially T-shaped cross-sectional shape. A cutter is held here centrally in a mounting part 20.1, which is directed radially to an axis of rotation of the cutting cylinder. The "transverse bar" of the T is formed by a guide part 20.2, which projects on both sides of the mounting part 20.1. The underside of the guide part 20.2 pointing toward the axis of rotation of the cylinder forms a contact surface 20.3 for the cutter bar 20. This contact surface 20.3 slides on a corresponding countersurface 9.3 of the cutting cylinder, which will hereinafter be called the displacing surface, during the displacement of the cutter bar in the circumferential direction of the cutting cylinder 9.

The adjustment of the cutter bar 20 in the circumferential direction of the cutting cylinder 9 is brought about by piston adjusting means 23, which are arranged on both long sides of the cutter bar 20 in the area of the side walls of a cylinder-side mounting groove for the cutter bar. Such a piston adjusting means 23 is formed with a clamping surface, which is displaceable in a straight line at right angles to the direction of displacement V of the cutter bar 20 and at right angles to the axis of rotation of the cylinder. The piston adjusting means 23 is displaceable in the manner of a piston in its guide provided in the cutting cylinder 9. The piston adjusting means 23 is continuously pretensioned for this purpose at one of its front-side end faces by the force of a spring assembly 22, while a pressurized medium, compressed air or hydraulic oil in this exemplary embodiment, can be admitted to it via a feed line 24 or 28 in the area of its opposite, front-side end face.

The adjustment of the cutter bar 20 is brought about by two planes extending obliquely in relation to the direction of adjustment V sliding on each other when the piston adjusting means 23 presses the cutter bar 20. On the sides of the cutter bar 20, these are the wedge surface 25, which is the right-hand wedge surface in the representation according to FIG. 2, and the left-hand wedge surface 27, which are provided at the guide part 20.2, opposite the contact surface 20.3. The piston adjusting means 23 have a corresponding opposing wedge surface 23.1 each, which extends complementarily to the respective corresponding wedge surface 25 or 27 of the cutter bar 20, i.e., the wedge surfaces 25, 27 and their opposing wedge surface 23.1 have the same slope angle $\alpha$. The slope angle $\alpha$ of the cutter bar-side guide surfaces 25 and 27 is the angle that is formed by each of the respective wedge surfaces 25 and 27 with the contact surface 20.3 of the cutter bar 20. Viewed in the cross-sectional representation, the opposing wedge surface 23.1 at the piston adjusting means 23 forms the same slope angle with the circumferential direction. The slope angle $\alpha$ of the preferred material pairs of the surfaces sliding on each other in the exemplary embodiment is about 30°, which preferably also represents at the same time a lower minimum for the slope angle for preventing the problem of self-locking from occurring in the first place. Due to this orientation of the wedge surfaces, the piston adjusting means 23 also acts at the same time as a tensioning device for the cutter bar 20, so that no additional means are needed any longer for clamping the cutter bar 20 onto its support.

The opposing wedge surface 23.1 of piston adjusting means 23 is designed as a recess on the side of the adjusting means facing the cutter bar 20, with the guide part 20.2 of the cutter bar extending into the said recess. One of the opposing side walls of the recess forms the wedge surface 23.1. The side walls of the groove, in which the cutter bar 20 is accommodated, have a corresponding recess, so that the guide part 20.2 of the cutter bar 20 comes into contact with the piston adjusting means 23 only during the adjustment of the cutter bar 20. The piston adjusting means 23 itself is also set back by a certain amount behind the side wall of the mounting groove for the cutter bar 20 when viewed in the cross-sectional representation according to FIG. 2.

In the first stop position of the cutter bar 20 shown in FIG. 2, the piston adjusting means 23, which is the right-hand adjusting means in FIG. 2, exerts contact pressure on the wedge surface 25 of the cutter bar 20. The contact pressure is brought about by the compression spring assembly 22, while the pressure is released from the pressure line 24 acting as a pressure space. In contrast to this, pressure is admitted to the adjusting means 23, which is the left-hand adjusting means in FIG. 2, via its pressure line 28, and the pressure in the pressure line 28 is so high that the spring assembly 22 of the left-hand piston adjusting means 23 is compressed to the extent that the piston adjusting means 23 comes into contact with the hold-down strip 26. Due to the pressure of the right-hand piston adjusting means 23 on the right-hand wedge surface 25, the cutter bar 20 is pressed against the opposing surface of the cutting cylinder 9, which opposing surface faces its left-hand wedge surface 27 and forms a fixed stop for the cutter bar 20. This three-point bearing of the cutter bar 20, namely, at the two wedge surfaces 25 and 27 and at the contact surface 20.3, ensures the best possible fixation and tensioning of the cutter bar 20 in the fixed position.

To displace the cutter bar 20 from the first stop position shown in FIG. 2 into the second stop position shown in FIG. 3, pressure is admitted into the pressure line 24 of the right-hand piston adjusting means 23. The pressure is at the same time released from the pressure line 28 of the left-hand piston adjusting means 23. The entire spring force of the spring assembly 22 of the left-hand piston adjusting means 23 now loads the left-hand wedge surface 27 of the cutter bar 20, while the right-hand piston adjusting means 23 has been moved to the stop position against its spring assembly 22. The cutter bar 20 is now moved into its second, right-hand stop position against the opposing wedge surface 23.1 of the right-hand piston adjusting means 23 under this contact pressure of the left-hand piston adjusting means 23.

A plurality of opposing wedge surface 23.1 are arranged along the two long sides of the cutter bar 20 at equally spaced locations over the axial length of the cutter bar 20. As is shown in the longitudinal section A—A in FIG. 4, four piston adjusting means 23 each are provided for this on each side of the cutter bar 20 in the exemplary embodiment. The pressurized fluid is admitted to the four piston adjusting means 23 aligned with one another via the common pressure line 24 or 28. The pressure line 24 or 28 is designed as a simple blind hole in the cutting cylinder 9. The pressurized fluid is fed in via a swing joint on one side of the cutting cylinder 9. As is apparent from FIGS. 2–4, the adjusting means or adjusting pistons 23 are accommodated in simple holes directly behind the side wall of the mounting groove for the cutter bar 20 in such a manner that they can be displaced in a straight line. A hold-down strip 21 or 26 (FIG. 2) screwed on the outer circumference of the cutting cylinder 9 is used as an abutment for the spring assemblies 22. Two side stops 29, by which the cutter bar 20 (in the sectional view IV—IV, the cutter bar is the lower cutter bar in FIG. 2) is fixed in the axial direction of the cylinder, are also shown in the lower part of FIG. 4.

Figure 4:
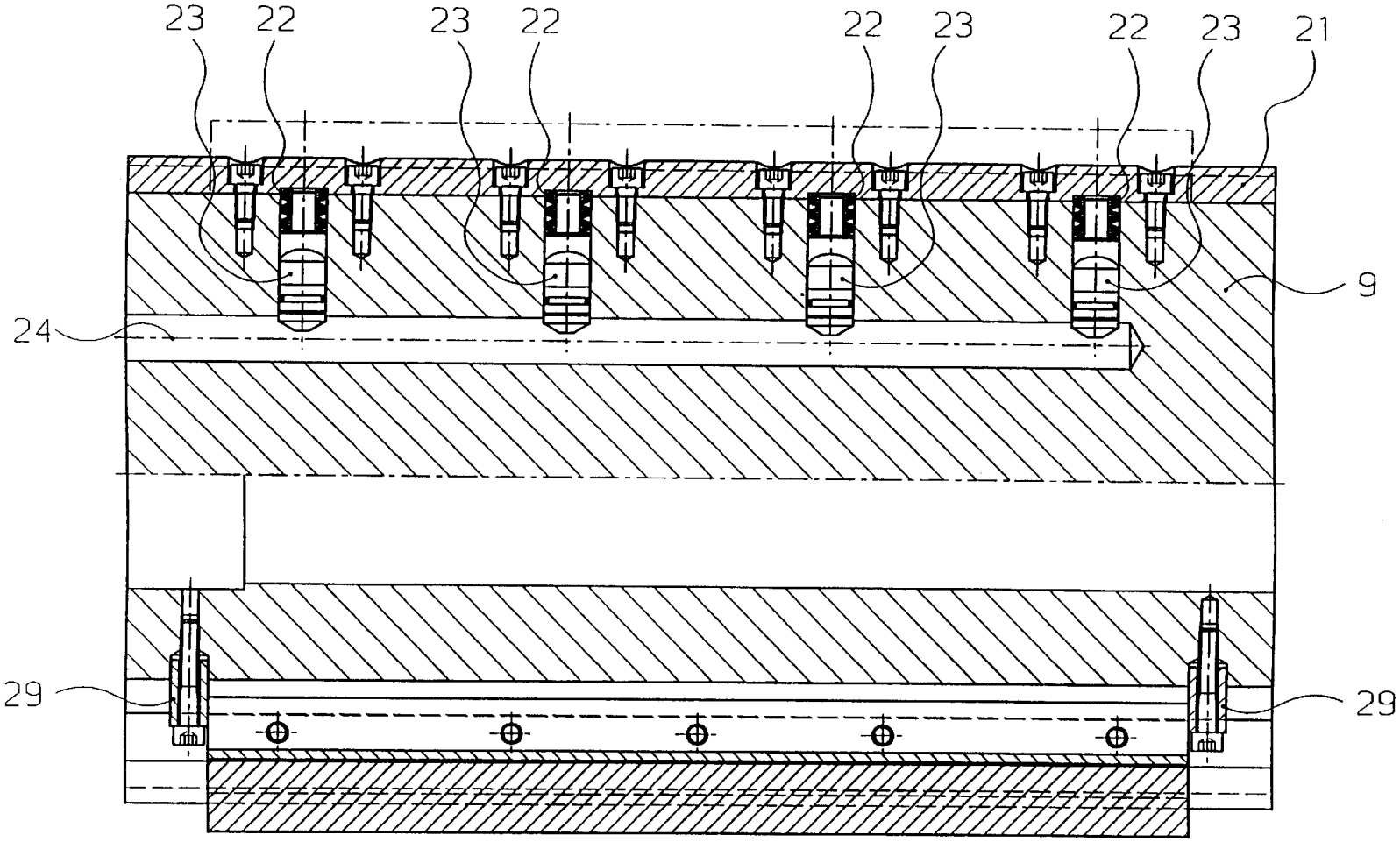
FIG. 4 is the sectional view taken along line IV—IV according to FIG. 2.
Figure 5:
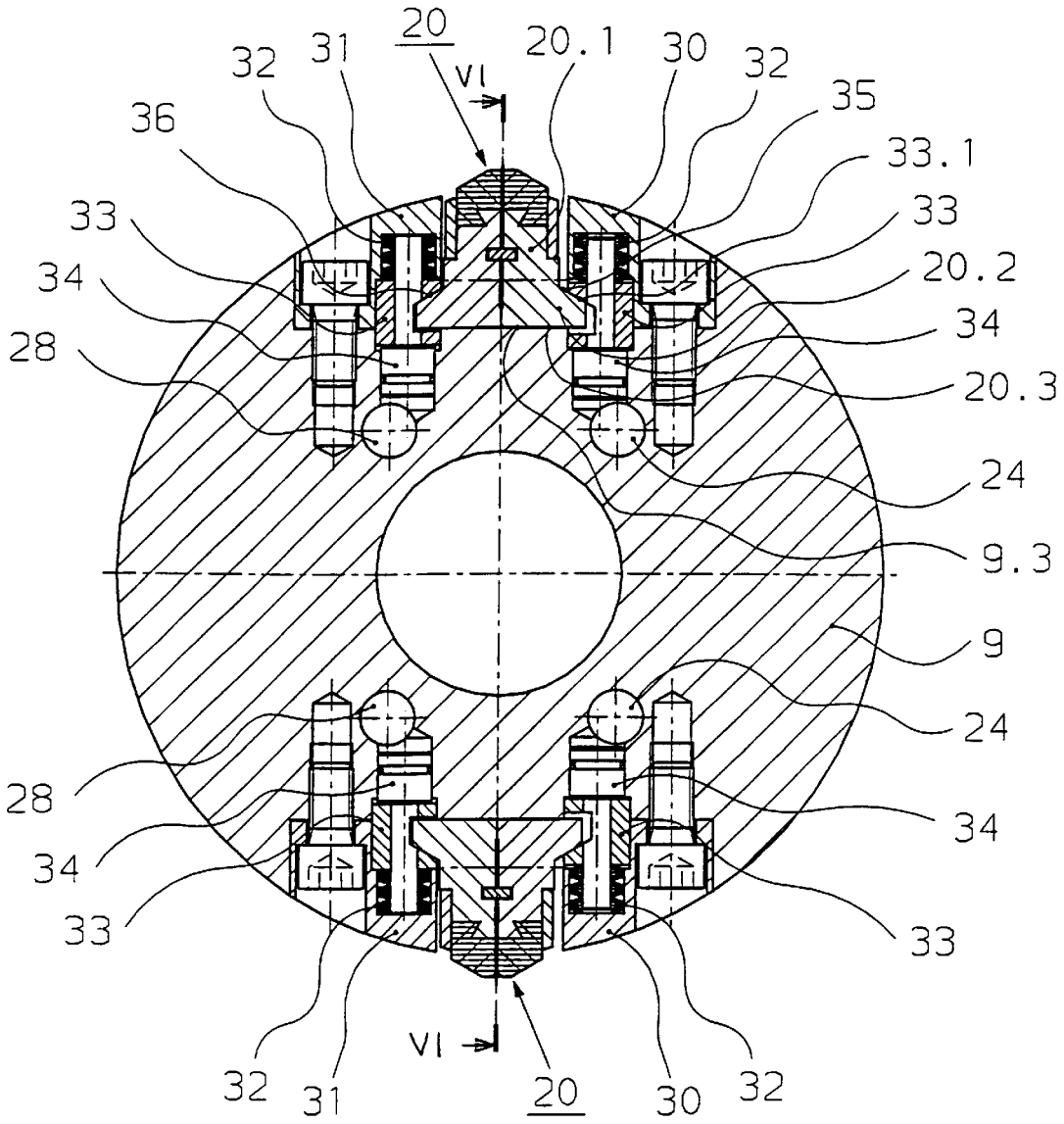
FIG. 5 is a sectional view showing a second exemplary embodiment of a cutting cylinder designed according to the present invention.
Figure 6:
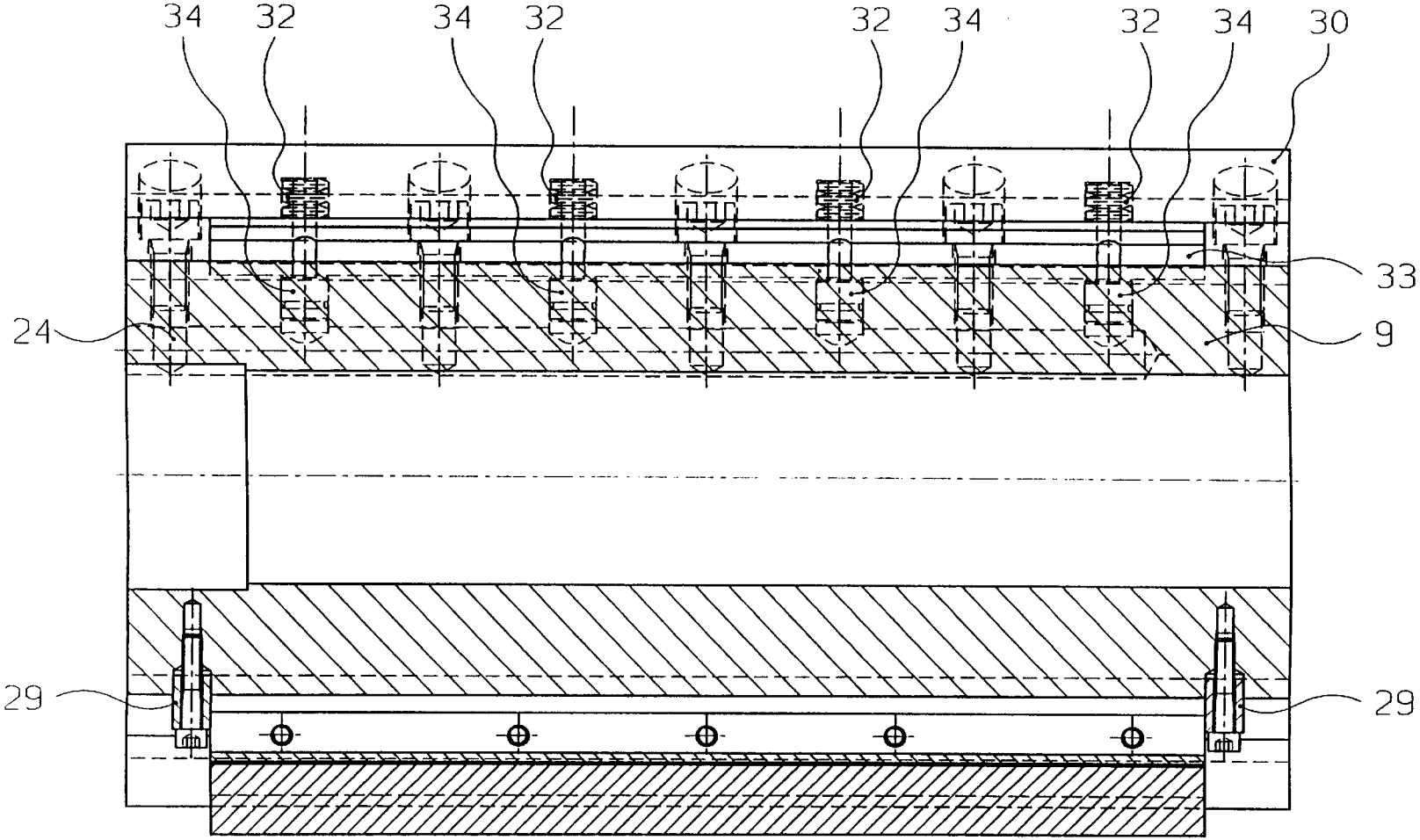
FIG. 6 is sectional view taken along line VI—VI according to FIG. 5.

An alternative embodiment of an adjusting device is shown in FIG. 5. While the piston adjusting means 23 in the exemplary embodiment according to FIGS. 2–4 is formed by a setbolt or adjusting piston each, which itself is provided with the opposing wedge surface 23.1, i.e., which acts directly on the cutter bar, the part of the adjusting means acting on the cutter bar 20 according to FIG. 5 is formed by an adjusting and clamping strip 33, which extends essentially over the entire axial length of the cutter bar 20. Like the piston adjusting means 23 according to FIGS. 2–4, this strip 33 is pretensioned by at least one compression spring assembly 32 to bring it into contact with the wedge surface 36 and the wedge surface 35 respectively of the cutter bar 20. This pretensioning force of the spring assembly 32 is counteracted by a pressure piston 34 arranged opposite the spring assembly 32. The mode of operation of the adjusting and clamping strip 33 according to FIG. 5 otherwise corresponds to that of the piston adjusting means 23 according to FIGS. 2 through 5, so that reference is made to the description pertaining to these figures. However, the hold down strips are 30 and 31 and the opposing wedge surface is 33.1. In the exemplary embodiment, as is shown in FIG. 6, four spring assemblies 32 are arranged distributed at equally spaced locations over the axial length of the strip 33 at the longitudinal edge of the strip 33, which edge is the outer edge when viewed from the axis of rotation of the cutting cylinder 9. A piston 34 is arranged opposite each of the spring assemblies 32 at a longitudinal edge of the strip 33, which edge is the inner edge when viewed from the axis of rotation of the cutting cylinder 9. Pressure can be admitted to the pressure pistons 34 via a common blind hole 24. The strip 33 and the pistons 34 may be made in one piece, but they are not made in one piece in the exemplary embodiment. The strip 33 is preferably made of a plastic material. For the other details of the embodiment variant according to FIGS. 5 and 6, refer to the description pertaining to the embodiment variant according to FIGS. 2 and 4.

Figure 7:
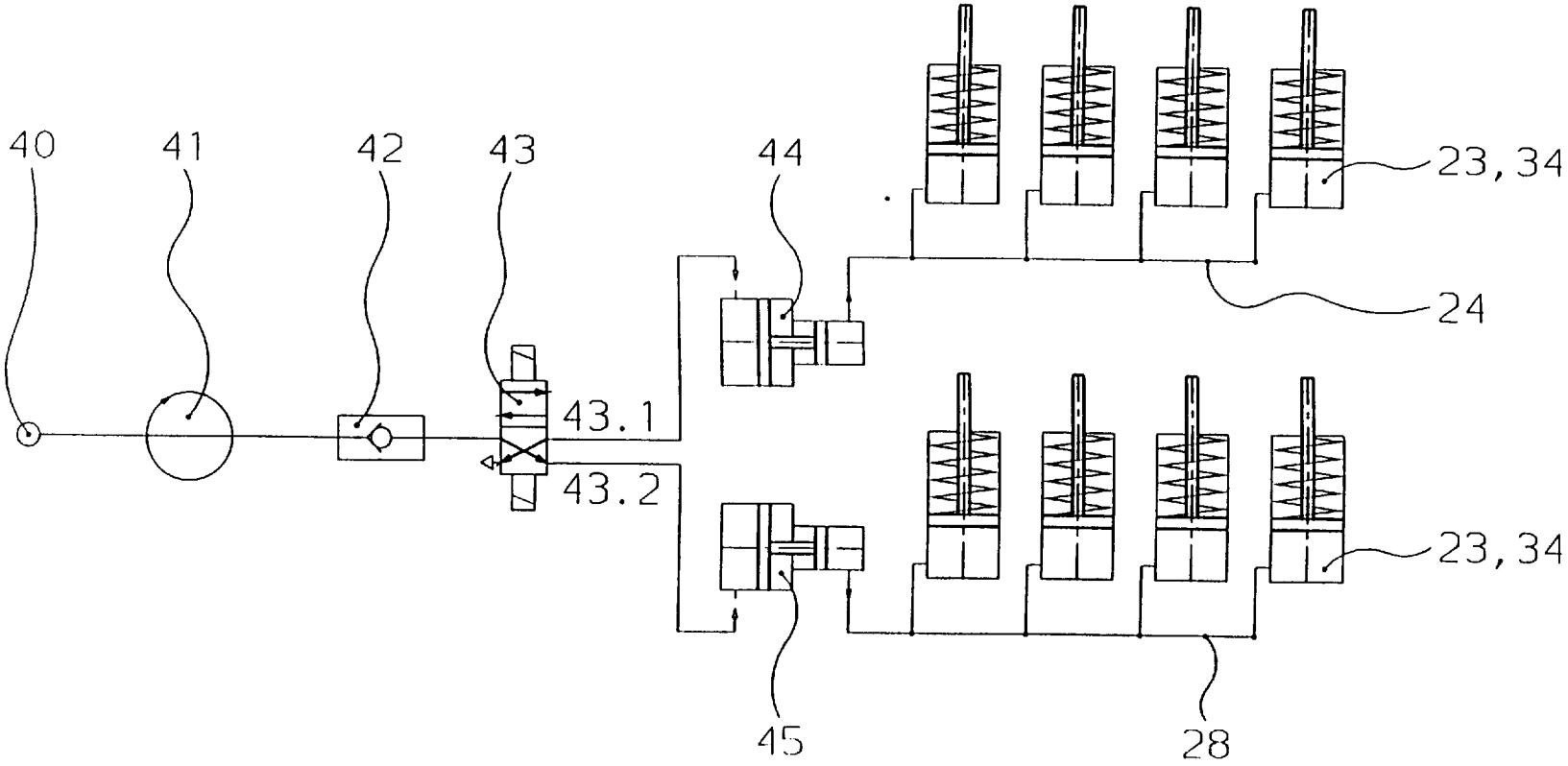
FIG. 7 is a schematic view of a first pressure change circuit for an arrangement of adjusting means for adjusting a cutter bar of a cutting cylinder according to FIGS. 2–6.
Figure 8:
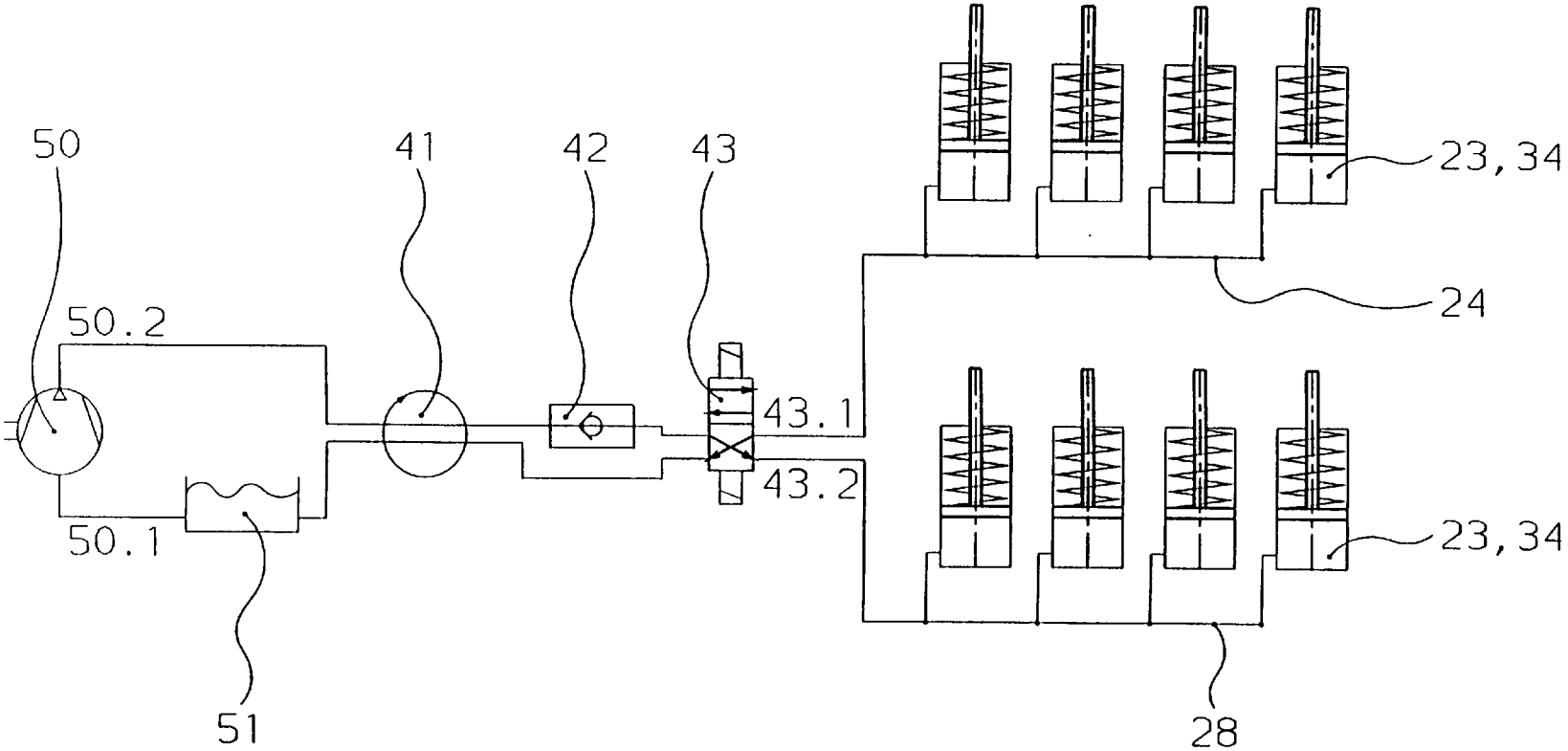
FIG. 8 is a schematic view of a second pressure change circuit for an arrangement of adjusting means for adjusting a cutter bar of a cutting cylinder according to FIGS. 2–6.
Figure 9:
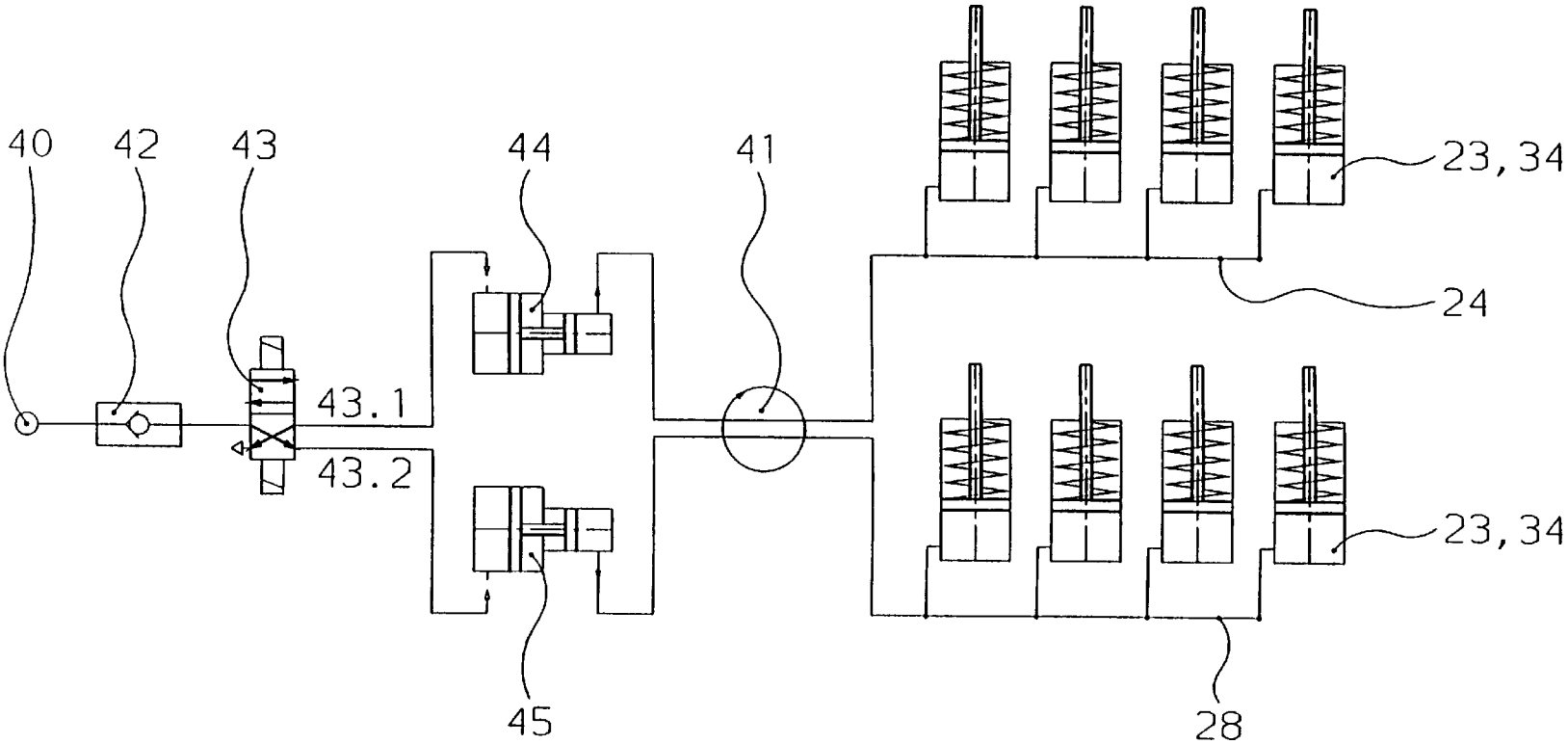
FIG. 9 is a schematic view of a third pressure change circuit for an arrangement of adjusting means for adjusting a cutter bar of a cutting cylinder according to FIGS. 2–6.

Three alternative embodiments for a pressure change circuit are shown in FIGS. 7 through 9. The pressure lines 24 and 28 and consequently the rows of respective pressure pistons of the piston adjusting means 23 and piston 34 (FIG. 2, FIG. 5) arranged on both sides of a cutter bar 20 are supplied with a suitable pressurized medium and the adjustment of the cutter bar 20 is controlled with such a pressure change circuit.

The pressure change circuit according to FIG. 7 is formed by a compressed air circuit and a hydraulic circuit, which are separated from one another by pistons 44 and 45. Compressed air is made available from a compressed air source 40 under a usual pressure of about 6 bar. It reaches a swing joint 41 from the compressed air source 40 via a line, and from there it reaches a four-/two-way valve 43 via a nonreturn valve 42. One each of the two outlets 43.1 and 43.2 of the valve 43 is in connection with an air pressure space of one of the two double-acting pistons 44 and 45. The second pressure space of each of these two pistons 44 and 45, which is located opposite the air pressure space, is filled with hydraulic oil. The oil pressure space of the piston 44 is in connection with the pressure line 24, and the oil pressure space of the piston 45 is in connection with the pressure line 28. In the resting position of the valve 43 shown, the air pressure of the compressed air source 40 is present at the outlet 43.2 of the valve 43. Compressed air is admitted to the piston 45 on one side. Pressure is thus admitted to the oil pressure line 28 via the double-acting piston 45. In contrast, the pressure is released from the other piston 44 via the valve 43. This correspondingly applies to the oil pressure line 24 connected to it as well. In the switching position of the valve 43 shown in FIG. 7, the cutter bar 20 or each cutter bar 20 assumes its stop position shown in FIGS. 2 and 5. The pressure ratios in the oil pressure lines 24 and 28 are reversed in the second switching position of the valve 43, i.e., the pressure is admitted to the piston adjusting means 23 and strip 33, which are the right-hand adjusting means in FIGS. 2, 3 and 5, so that they act as stops for the cutter bar or cutter bars 20, and these cutter bars 20 assume the stop positions shown in FIG. 3. The series connection with one compressed air circuit and with two hydraulic circuits, which is shown in FIG. 7, offers the advantage that the swing joint 41, being a connection member to the rotating cutting cylinder, carries only compressed air, which entails at least no additional contamination problems in the case of a leakage. The nonreturn valve 42 prevents a pressure drop from occurring should the compressed air source 40 fail or should the swing joint 41 develop a leak.

FIG. 8 shows an alternative pressure circuit, which is operated exclusively with hydraulic oil. A pump 50 delivers hydraulic oil from an oil reservoir 51 to a swing joint 41 via a line 50.1 and via its pressure outlet 50.2 and from there to the four-/two-way valve 43 via the nonreturn valve 42. The oil pressure is present at the valve outlet 43.2 in the switching position of the valve 43 shown in FIG. 8, so that pressure is admitted into the pressure line 28. The pressure line 24 is in connection with the second outlet of the valve 43, which in turn is connected to the oil reservoir 51 via the swing joint 41 in the representation shown in FIG. 8, so that the pressure is again released from the pressure line 24. The same pressure ratios become established as in the pressure circuit according to FIG. 7. The pressure ratios are reversed in the second switching position of the valve 43. The use of an exclusive hydraulic circuit has the advantage of especially rapid switching times.

Compressed air is again supplied by a compressed air source 40 and is again sent to the four-/two-way valve 43 via a nonreturn valve in the third alternative of the pressure change circuit shown in FIG. 9. The two outlets 43.1 and 43.2 of this four-/two-way valve are again in connection with the double-acting pistons 44 and 45. As in the example according to FIG. 7, there is one end uncoupling each of the air circuit and oil circuit due to the two pistons 44 and 45. Compressed air is admitted to one side of the piston, and hydraulic oil is admitted to the other. The oil pressure chamber of the piston 44 is in connection with the pressure line 24 via the swing joint 41, and the oil pressure chamber of the piston 45 is in connection, likewise via the swing joint 41, with the pressure line 28. The same pressure ratio will again become established in the switching position of the valve 43 according to FIG. 9 as in the preceding two cases. Switching of the valve 43 will again bring about a reversal of the pressure ratios. The switching takes place in this variant outside the rotating cylinder and consequently advantageously stationarily.

While specific embodiments of the invention have been shown and described in detail to illustrate the application of the principles of the invention, it will be understood that the invention may be embodied otherwise without departing from such principles.

What is claimed is:

1. A cutting cylinder for transversely cutting or perforating a material web running in a rotary press, comprising:

a displacing surface forming a part of the cutting cylinder;

a cutter bar pressing against said displacing surface, said cutter bar having a contact surface and a first longitudinal side with a first wedge surface and a second longitudinal side with a second wedge surface;

a first adjusting means for displacing said cutter bar in a circumferential direction, said first adjusting means being connected to said cutter bar in a frictionally engaged manner pressing said cutter bar via said first wedge surface, said first wedge surface being directed toward said displacing surface to form an acute angle with said displacing surface; and a second adjusting means for displacing said cutter bar in another circumferential direction, said second adjusting means being connected to said cutter bar in a frictionally engaged manner pressing said cutter bar via said second wedge surface, said second wedge surface being directed toward said displacing surface to form an acute angle with said displacing surface.

2. A cutting cylinder in accordance with claim 1, wherein said first adjusting means is displaceable to and fro in a straight line essentially at right angles to said displacing surface.

3. A cutting cylinder in accordance with claim 1, wherein one of said first and second adjusting means may be positioned to form a fixed stop for said cutter bar.

4. A cutting cylinder in accordance with claim 1, wherein said first adjusting means includes a spring generating an elastic pretensioning force to apply contact pressure to said cutter bar.

5. A cutting cylinder in accordance with claim 4, further comprising: opposing force means for applying an opposing force to the contact pressure of said first adjusting means on said cutter bar.

6. A cutting cylinder in accordance with claim 5, wherein said opposing force means comprises a pressurized medium applied to said first adjusting means.

7. A cutting cylinder in accordance with claim 1, further comprising opposing force means for applying an opposing force to said first adjusting means and said second adjusting means.

8. A cutting cylinder in accordance with claim 1, further comprising: opposing force means for applying an opposing force to contact pressure of said first adjusting means wherein said first adjusting means comprises at least one bolt forming a piston, said bolt having a first end face and a second end face, and a compression spring acting on said bolt first end face, said opposing force means comprising a pressurized medium applied in an area of said bolt second end face.

9. A cutting cylinder in accordance with the above claim 8, wherein a plurality of said bolts are arranged along a longitudinal direction of said cutter bar.

10. A cutting cylinder in accordance with claim 1, further comprising: opposing force means for applying an opposing force to said first adjusting means, wherein said first adjusting means comprises a strip having a first long side and a second long side located opposite the first long side, said strip extending along said cutter bar, and at least one compression spring in contact with said strip for generating contact pressure of said strip on said cutting bar and acting on said first long side of said strip, said opposing force means comprising a pressurized medium admitted on said second long side of said strip.

11. A cutting cylinder in accordance with claim 1, wherein said cutter bar comprises a cross-sectional shape which is T-shaped with a mounting part radially pointing away from an axis of rotation of said cutting cylinder and defining a cutter receiving part, and with a guide part projecting beyond said mounting part on both sides of said cutter bar.

12. A cutting cylinder in accordance with claim 1, wherein said acute angle of said first wedge surface is selected depending on a material of said cutter bar, a material of said cutting cylinder and a material of said first adjusting means, such that interfaces are not self-locking.

* * * * *